United States Patent [19]

Maurer

[11] 4,384,385

[45] May 24, 1983

[54] CLEANER WITH SIDE CLEANOUT

[75] Inventor: Edgar A. Maurer, Canton, Ohio

[73] Assignee: The Hoover Company, North Canton, Ohio

[21] Appl. No.: 264,448

[22] Filed: May 18, 1981

[30] Foreign Application Priority Data

Nov. 28, 1980 [GB] United Kingdom ..... 8038288

[51] Int. Cl.[3] ..... A47L 9/00

[52] U.S. Cl. ..... 15/339

[58] Field of Search ..... 15/339, 352, 334, 337

[56] References Cited

U.S. PATENT DOCUMENTS 1,577,070 3/1926 Orr .

2,140,143 12/1938 Sellers et al. ..... 15/337 X 3,188,681 6/1965 Jepson et al. ..... 15/337

3,813,725 6/1974 Rinker ..... 15/337 X 4,023,234 5/1977 Martinec et al. ..... 15/416 X 4,219,900 9/1980 Dyer ..... 15/339

FOREIGN PATENT DOCUMENTS 2043432 8/1980 United Kingdom .

*Primary Examiner*—Chris K. Moore

*Attorney, Agent, or Firm*—G. H. Kreske; R. B. Farley

[57] ABSTRACT

A floor care appliance or the like is provided with a duct clean out function by the use of a stoppered, sidewardly extending duct accessible to the user through the closure.

8 Claims, 4 Drawing Figures

CLEANER WITH SIDE CLEANOUT

BACKGROUND OF THE INVENTION

1. Field of the Invention

This invention relates to floor care appliances and, more particularly, relates to a floor care appliance having a clean out access aperture.

2. Description of the Prior Art

The use of clean out arrangements for upright vacuum cleaners is broadly old. The most notable example known to Applicant is a vacuum cleaner having a removable pan on its bottom, much like a bottom plate. A wire screen is disposed above this pan in the suction tube so that large foreign particles are deposited on the pan. The pan is then opened by turning the upright vacuum cleaner up or over so that front access to the debris is had.

Obviously, then, an opening which did not require an upturning or overturning of the cleaner to facilitate duct clean out would be advantageous.

It is an object of the invention, therefore, to provide a side clean out that does not necessitate tilting or turning the appliance over.

It is a further object of the invention to include a duct in the floor care appliance that extends along the side of it for easy ingress and accessibility for clean out purposes.

It is a still further object of the invention to provide a stoppered, easily removable element for closing the sidewardly disposed duct.

It is still a further object of the invention to provide an improved clean out arrangement for the removal of large dirt and debris from a vacuum cleaner.

SUMMARY OF THE INVENTION

According to the present invention, a cleaner main body is provided with a sidewardly extending duct which communicates with the agitator chamber at its forward end and with the motor fan system at its rearward end. The duct is formed partly in the main body and is capped by an elongated section of generally U-shaped cross section so as to form an enclosed configuration which seatingly communicates suction cleaner air rearwardly of the main body. The connection of this duct to the fan eye of the fan motor system is offset vertically from the general extent of the duct so that large dirt particles, etc. are not re-entrained in the flowing air stream. This portion of the duct is also enlarged relative to the cross section of the duct going to the fan eye for the same purpose. A cutout is formed in a continuation of the enlarged portion in the side of the duct, with a corresponding discontinuity in the main body to provide for an aperture which opens outwardly in the side of the duct for ingress to the internal periphery of the duct for cleanout purposes. A sonic welded ring-like member is mounted with the main body and the duct, at this aperture, so as to provide a connection means for a stopper which normally blocks ingress into the trap portion of the duct. A stopper, including a pair of sidewardly extending tabs, is utilized to close the aperture, with these tabs in bayonet-like fashion engaging the stopper with the ring-like member.

DESCRIPTION OF THE DRAWINGS

The invention may be carried in practice in various ways but one specific embodiment will now be described by way of example in which.

DESCRIPTION OF THE PREFERRED EMBODIMENT

Figure 1:
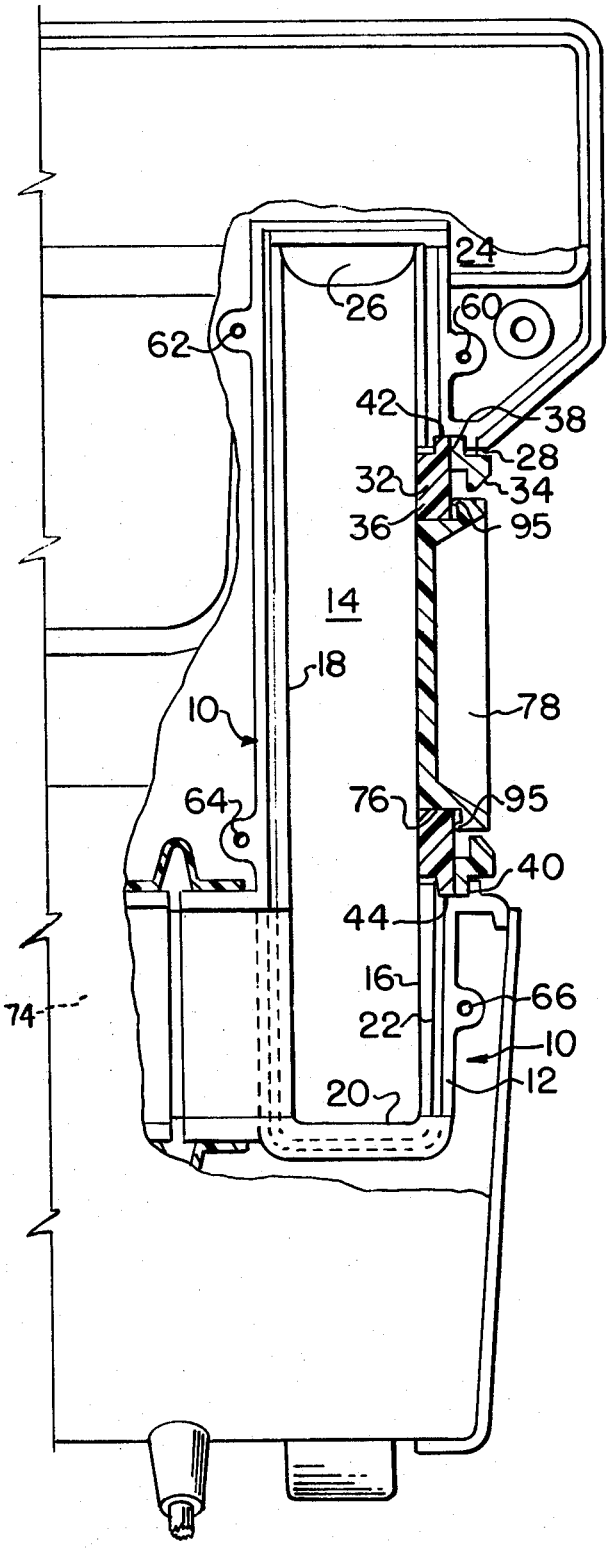
FIG. 1 is a plan view, partly in section, generally, of the duct containing side of the main body with the duct cap removed so as to show details of the formation of the duct portion in the main body.
Figure 3:
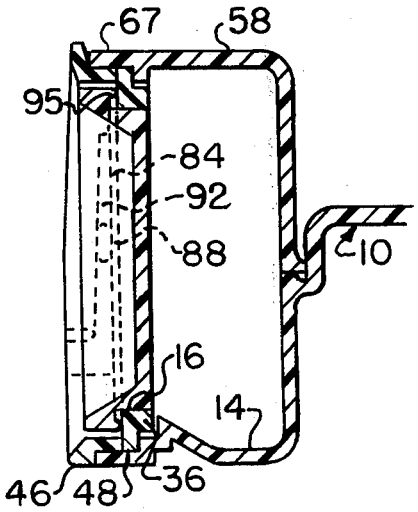
FIG. 3 is an elevational sectional view of the duct taken on line 3—3 of FIG. 2.
Figure 2:
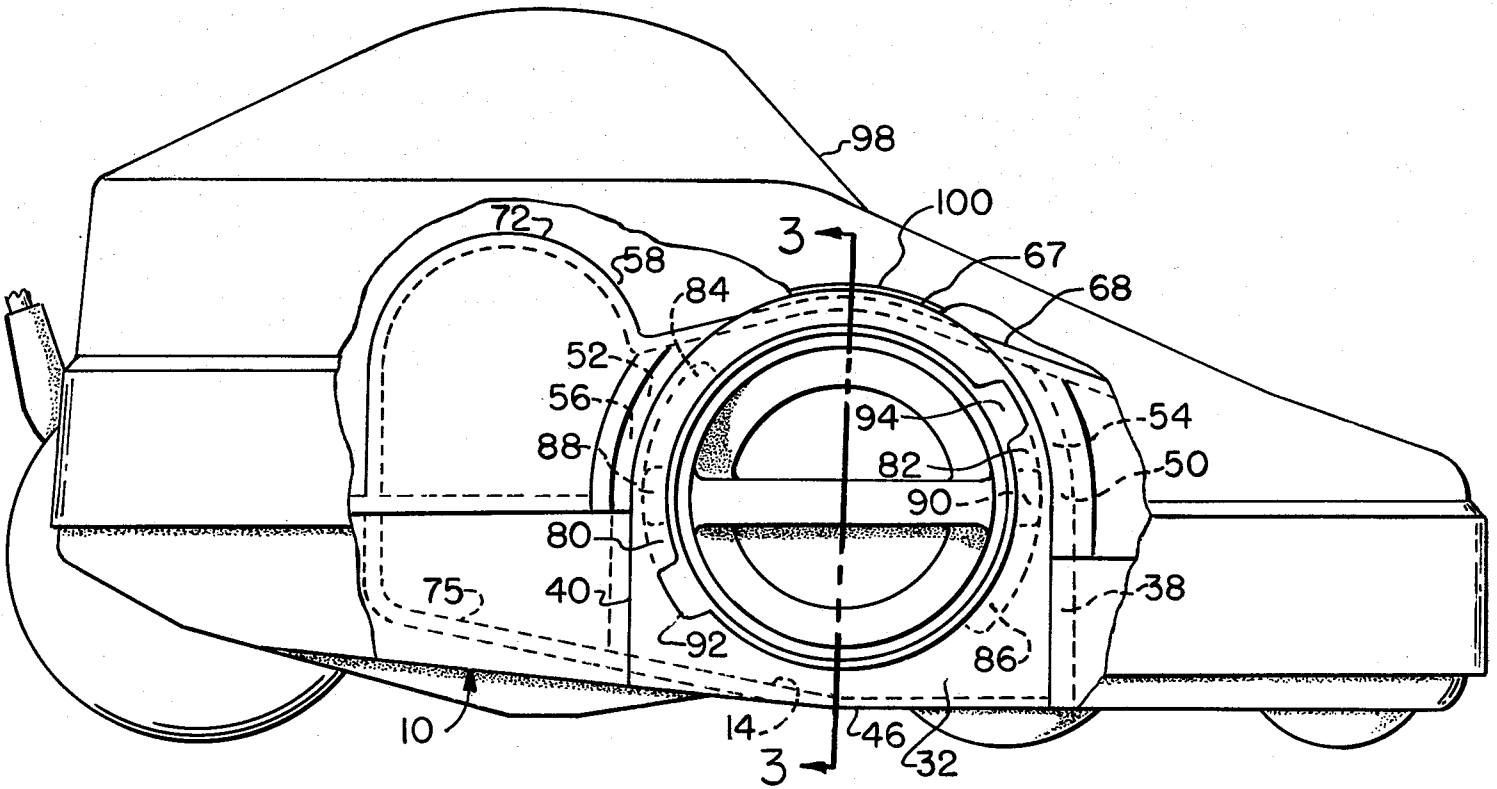
FIG. 2 is a general side elevational view of the duct side of the cleaner with the duct cap and stopper in assembled condition.

The main body 10 of the invention is best seen in FIG. 1 wherein it is shown that an integral duct portion 12 having a depressed bottom 14 and side walls 16 and 18 is found. The duct portion 12 also includes an end wall 20 with a groove 22 extending generally around the end and side walls so that a sealing gasket, (not shown) may be disposed in the upper terminations of these walls and end, if desired, although face to face contact is preferred with the abutting surface (to be described). The duct portion 12 communicates forwardly with an agitator chamber 24 through an opening 26.

In the side of the main body 10 is a discontinuity or a cutout 28. In the cutout 28 is disposed a stopper retaining or retainer member 32 comprising a pair of generally conforming pieces 34, 36 which may be ultrasonically welded together to form a single unitary structure. Stopper retainer member 32 includes a pair of outwardly extending tab portions 38, 40 (on conforming piece 36) which extend along its vertical sides so that the stopper retaining member 32 can be sealingly attached to main body 10 by means of grooves 42 and 44 formed therein which also extend vertically. The front portion of conforming piece 34 at its bottom side 47 includes an overlapping lip 46 that extends along the front side of the stopper retaining member 32 and overlaps a conforming edge 48 on the main body. The bottom side 47 forms a seal with conforming edge 48.

In order to maintain the top portion of stopper retainer member 32 rigid with the main body 10, tab portions 38 and 40 are extended upwardly in a curvilinear fashion to merge with the top portion of the stopper retainer member 32. Thus, the curvilinear portions 50 and 52 are integral with the tab portions 38 and 40, respectively. These curvilinear portions are sealingly trapped in curvilinear channels 54 and 56 extending from a duct cap 58 which, itself, extends in linear fashion along the duct portion 12 so as to provide a cover for the same. In furtherance of this arrangement, then, duct cap 58 is screwingly attached to duct portion 12 by means of a series of fastening holes 60, 62, 64 and 66. This positively locates the stopper retainer member 32 fixed relative to the main body 10 and the duct portion 12 and duct cap 58. An upper lip or rim 67 on the stopper retainer member 32 lies closely against the duct cap outside wall 69 to cap this area, with a seal provided inwardly thereof by the conforming parts formed by the telescoping of the stopper retaining member 32 and duct cap 58 at their tops.

Duct cap 58 has a generally expanding volume moving from its front towards the stopper retaining member 32 formed by an angulated portion 68 and a crown section 70 joined to it. A partly circular eye portion 72 of even larger (height) dimensions is joined to the crown section 70 to provide an enlarged cross sectional flow area which leads into the eye of the motor fan unit 74. It should be noted that the bottom side 14 of the duct portion 12 is vertically displaced by a considerable distance below the center of the eye portion 72 of the duct cap 58 and that the volume occupied by the duct portion 12 and duct cap 58 in the area of the stopper retaining member 32 and the entrance to the motor fan system 74 is greatly enlarged over the beginning portion of the total duct in the area of the duct portion 68. This expanding volume provides a drop-out zone for the deposit of large dirt particles, pins and the like on the bottom 14 of the duct 12 so that the same are not carried into the motor fan unit 74 and, possibly, further along to the cleaner bag (not shown).

It should also be noted that the bottom 14 of the duct portion 12 is angled near the fan eye by an angled portion 75 that would tend to encourage dirt and debris to slide down the duct portion 12 towards the discontinuity or cutout 28.

Figure 4:
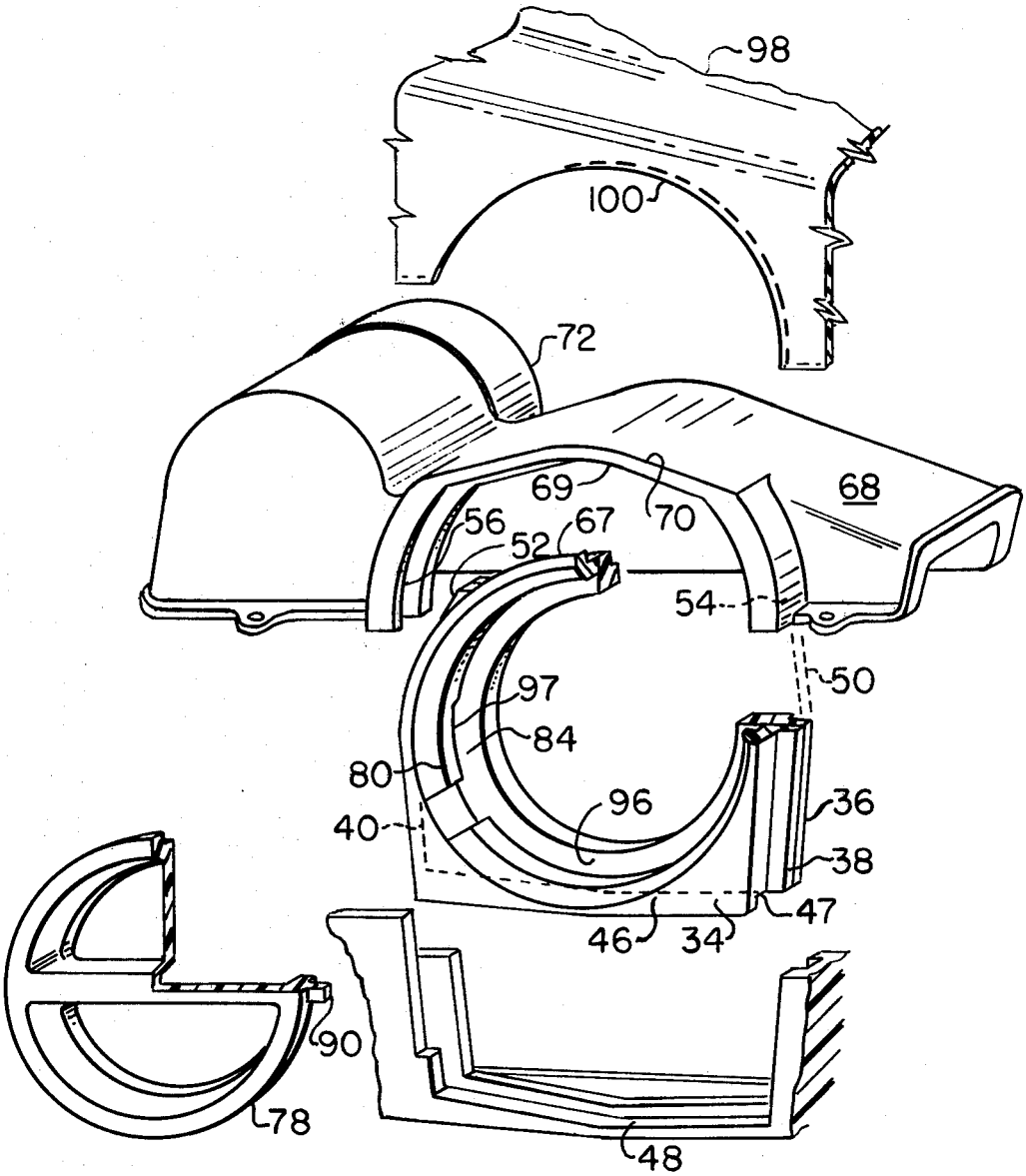
FIG. 4 is an exploded perspective view of the stopper area, of the duct and hood.

Mounted in a circular aperture 76 of stopper retainer member 32 is a stopper 78. A pair of partially arcuate lips 80, 82 on the stopper retaining member 32 provides a means to trap the stopper 78 in the circular aperture 76. This occurs because a pair of partially arcuate slots 84 and 86 are disposed behind the lips 80 and 82, respectively, and extend fully there along with a pair of tabs 88 and 90 on the stopper 78 rotated into these slots in bayonet fashion. Notches 92 and 94 which open outwardly of the stopper retaining member 32 provide ingress for the insertion of the tabs 88 and 90 therein, a consequent turning of the stopper 78 with the same within the circular aperture 76 sealingly provides a continuous sealed corridor for the flow of the air from the agitator chamber 24 to the eye of the motor fan unit 74. A sealing rib 95 is formed on the stopper 78. Sealing of the stopper 78 occurs because the same abuts (through sealing rib 95) against a circular face seal portion 96 on the conforming piece 36 of stopper retainer member 32. Positive movement of the stopper 78 to this position is occasioned by the shape of the partially arcuate slots 84, 86 which are wedge shaped on their outer sides to provide an inwardly slanting surface 97 (FIG. 4) that urges the stopper 78 against circular face seal portion 96.

A hood 98 can be furnished for main body 10 with a cutout or discontinuity 100 to provide access to stopper 78.

It should be obvious that the main provisions for the invention have been carried out and that a sidewardly extending duct arrangement has been provided with a trap and cleanout to remove from a cleaner large foreign objects such as large particles of dirt, debris, coins, screws, pins, etc. to prevent damage to the fan such as blade breakage. It should also be obvious that only a preferred embodiment of the invention has been shown and it may take many other forms which would still fall within the spirit the disclosure rendered.

What is claimed is:

1. A cleaner main body forming the bottom reaches of a cleaner wherein:

(a) a dirt conveying duct extends along one side, (b) a discontinuity is disposed at the side of said main body adjacent a portion of said duct, and extends generally vertically upwardly, (c) a stopper aperture arrangement is located in the side of said duct, (d) the stopper of said stopper arrangement being located at the side of said duct at the discontinuity of said main body, (e) a hood covering said cleaner main body and being disposed generally above it, (f) a cutout in said hood extending generally vertically and being located at the side of said duct at said stopper of said stopper arrangement.

2. The cleaner main body of claim 1 wherein;

(a) said duct has a bottom slanting away from an eye of a motor fan unit to urge dirt towards said stopper.

3. The cleaner main body of claim 1 wherein;

(a) at least a lower portion of a horizontal extent of said duct is formed by said cleaner main body, and (b) a separate duct cap covers said horizontal extent of said lower portion of said duct.

4. A cleaner main body wherein:

(a) a dirt conveying duct extends along one side, (b) a discontinuity is disposed at the side of said main body adjacent a portion of said duct, (c) a stopper aperture arrangement is located in the side of said duct, (d) the stopper of said stopper arrangement being located at the discontinuity of said main body, (e) at least a lower portion of said duct being formed by said cleaner main body, (f) a separate duct cap covering said horizontal extent of said lower portion of said duct, and (g) a stopper mounting member of said stopper mounting arrangement trapped between said duct cap and said lower portion of said main body.

5. The cleaner main body of claim 4 wherein;

(a) said stopper mounting member extends into means forming a channel on said cleaner main body.

6. The cleaner main body of claim 5 wherein;

(a) said stopper has bayonet type tabs, (b) said stopper mounting member receives said tabs in arcuate channels, and (c) walls of said channels force said stopper into seating engagement with said stopper mounting member.

7. A cleaner main body forming the bottom reaches of a cleaner wherein;

(a) a dirt conveying duct extends along one side of said main body and generally above it, (b) a closeable aperture is disposed in the side of said duct, (c) a cleaner hood for covering said cleaner main body is disposed generally above it and said duct and includes a cutout extending generally vertically and situated adjacent to said closeable aperture to permit access to it.

8. A cleaner main body forming the bottom reaches of a cleaner wherein;

(a) a dirt conveying duct extends along said main body, (b) a dirt trap is formed in said dirt conveying duct, (c) a closeable aperture is disposed in said duct contiguous to said dirt trap, and (d) a cleaner hood for covering said main body is disposed generally above it and said duct and includes a cutout situated adjacent to said closeable aperture to permit access to it.

* * * * *